United States Patent [19]

Krebs et al.

[11] Patent Number: 4,720,249

[45] Date of Patent: Jan. 19, 1988

[54] PERISTALTIC PUMP WITH ENHANCED TUBE LOADING FEATURES

[76] Inventors: Helmut Krebs, 4849 N. Kenneth Ave., Chicago, Ill. 60630; Jerrold Widran, 60 Estate Dr., Glencoe, Ill. 60022

[21] Appl. No.: 865,896

[22] Filed: May 21, 1986

[51] Int. Cl.[4] ..... F04B 43/12

[52] U.S. Cl. ..... 417/477

[58] Field of Search ..... 417/477, 476, 474, 475; 418/45

[56] References Cited

U.S. PATENT DOCUMENTS 4,142,845 3/1979 Lepp et al. ..... 417/477

4,568,255 2/1986 Lavender et al. ..... 417/477

FOREIGN PATENT DOCUMENTS 2452771 5/1976 Fed. Rep. of Germany ..... 417/477

*Primary Examiner*—Carlton R. Croyle

*Assistant Examiner*—Leonard P. Walnoha

*Attorney, Agent, or Firm*—Michael G. Berkman

[57] ABSTRACT

A peristaltic pump of the type in which a motor-driven hub rotates hub-carried rollers in stressing engagement against to compress a fluid-carrying tube seated in the pump, thereby to propel the liquid through the tube. The pump is characterized in that the functional positioning or loading of the fluid-carrying tubing into and the removal of the resiliently compressible, fluid-carrying tubing from the pump housing is facilitated by apparatus for retracting the tube-compression, fluid-impelling rollers radially inwardly toward the core or hub of the pump and away from an outer bounding wall of a channel in which the compressible section of the tubing is seated. The improvement described effectively removes the rollers as physical impediments during loading of the tube into, and during unloading of the tubing from the pump.

11 Claims, 15 Drawing Figures

20
24
28
32
42
50
54
60
64
68
72
80
82
86
88
92
94
98
102
116
122
350
356
376
410
420
430
434

180
430
410
356
376
388
400
406
412
370
354
372
106
122
350
398
404
426
390
418
102
118
360
110
380
116
24
424
402
420
414
364
366
384
246
244
248
258
260
166
252
170
254
234
148
160
238
156
228
240
226
232
262
294
154
164
162
172
222
224
64
60
66
290

PERISTALTIC PUMP WITH ENHANCED TUBE LOADING FEATURES

FIELD AND BACKGROUND OF THE INVENTION

The present invention relates to a peristaltic pump of the type used to propel liquid through a compressible tube or a conduit which includes at least a resiliently compressible sector or section. More particularly, the invention is directed to a peristaltic pump in which insertion of resiliently compressible tubing into during loading of the pump and withdrawal of the tubing from the pump housing is facilitated.

Pumps of the type in which the fluids or fluid-like materials being "moved" are isolated from and do not come into direct physical contact with cavities or mechanical elements of the pump itself are known in the art. Such pumps have been used in conjunction with the displacement of many different types of materials to be handled, and the pumps themselves have assumed many and varied mechanical arrangements and structures. Typical of a general type of pump of the class referred to are peristaltic, or hose, or tube-compressing pumps.

The peristaltic pumps commonly include a motor-driven hub or rotor which carries outwardly-directed, circumferentially-disposed, and annularly-spaced arms or compression rollers. As the driven hub rotates, the spaced rollers are brought sequentially into contact with so as radially and advancingly repetitively to compress (and to permit expansion of) a sector or lineal section of a resiliently compressible tube seated in and contiguously abutting and bearing against a bounding wall of an arcuate channel provided in the pump body or housing and having a generally uniform radius of curvature. The tubing-carried fluid is pumped through the tubing in the direction of the annular sequential movement of the compressing rollers.

The confined section of resilient tubing, while functioning effectively as part of the pump, serves to preserve a sealed and isolated fluid flow system in which the fluid is also protected against contact with the pump structure itself.

Peristaltic pumps of the type described have included spring mechanisms for resiliently biasing the tube-engaging and tubing-compressing rollers or arms radially outwardly toward a bounding wall of the arcuate channel and against the compressible section of tubing confined in the channel. The specific arrangements of such biasing springs have varied. Typical structures are described in U.S. Pat. Nos. 3,822,948; 3,963,023 and 4,210,138.

A significant problem in the effective utilization of peristaltic pumps is associated with the operational steps of loading the tubing into and removing the tubing from the pump body. The difficulty and inconvenience experienced are associated with effectively manipulating the tubing into place within the tubing-confining channel of the pump. The compression rollers or tube-compressing arms constitute mechanical impediments which interfere with the ease of insertion and the proper placement of the compressible tubing section into the pump housing.

For example, when peristaltic pumps are used in the medical field, including for urological procedures, it is necessary either physically radially to retract or to displace each interfering roller, in turn, against the significant opposing pressure of a spring which biases the compression arm or roller radially outwardly against the resilient tubing. Alternatively, it is necessary digitally to compress the tubing, at each of several annularly spaced positions of the tubing-receiving channel, so that the tubing can be properly and functionally seated and oriented. In carrying out either technique, the procedure invoked is time consuming. Moreover, a considerable degree of dexterity and skill is required. In some instances the necessary manipulation steps may even expose the doctor, nurse or medical technician to possible injury.

In specific prior art peristaltic or hose-type pumps it is known to provide mechanisms by which the squeezing rollers will be "lifted" or urged into a partially retracted mode in response to increased pressure in the fluid-carrying tube itself. Peristaltic pumps of the type in which the weight of the drive motor determines the force with which the pinching or occluding rollers bear against the housing-confined section of tubing are known in the art. In one such device, the motor has been mounted on a rocker arm so that, if necessary, pumping can be stopped quickly by lifting and supporting the rocker arm (and the motor assembly) functionally to disengage the compression rollers from the tubing section. However, neither this nor any other mechanical arrangement of prior art devices is directed to or serves to alleviate the difficulties inherent in loading the tubing sector into and removing the tubing from the pump assembly. It is, accordingly, a principal aim of the present invention to obviate the problems present in prior art peristaltic pumps and, particularly, the problems associated with insertion of the resiliently compressible tubing into and the removal of the tubing from such pumps.

SUMMARY OF THE INVENTION

The present invention finds utility in peristaltic pumps of the type which include a plurality of annularly spaced rollers and a motor driven rotor supporting the rollers and bringing the rollers sequentially into functional stressing engagement with, compressingly to traverse a section of resiliently compressible tubing positioned in the pump assembly and thus to propel fluid through the tubing.

It is a principal feature of the pump of the present invention that it includes mechanisms which are operable for selectively shifting the rollers between a first, functional position in which the rollers are presented radially outwardly of the roller-carrying rotatable hub or rotor sequentially to bear upon, compress, and to travel along the confined tubing sector to effect propelled transmission of fluid through the tubing, and a second, tubing loading and tubing removal position in which the rollers are retracted radially inwardly and away from the tubing to free the tubing and to facilitate simple and unimpaired manipulation of the tubing into and removal of the tubing from the tubing channel in the pump housing.

It is a related feature of the pump of the invention that radial retraction of the tubing-compressing rollers from the tubing renders the tubing section readily accessible without mechanical impediments which have heretofore interfered with and complicated tubing insertion into and tubing removal from the pump.

One preferred embodiment of the pump of the invention is characterized in that there are provided hydraulically controlled piston-and-cylinder type mechanisms by means of which the rollers are urged radially outwardly so as functionally to engage the pump-carried tubing sector, the hydraulic mechanisms being controllably releasable selectively to permit retraction of the rollers radially inwardly and away from the tubing channel in the pump assembly during entry of the tubing into and removal of the tubing from the pump.

A related feature of the invention is a spring element for biasing the tubing-compressing rollers radially inwardly toward the hub of the rotary assembly and out of a functional, tubing-compressing mode when the roller-positioning apparatus is shifted to its roller-retracting disposition.

In one preferred embodiment of the invention, shifting of the rollers radially outwardly into stressing engagement against and into compression with the tubing is achieved through gearing components which are operative simultaneously on the annular array of roller assemblies to effect controlled displacement of the rollers to being them forcibly to bear against the pump-confined tubing.

In another embodiment of the invention the controlled positioning of the tubing-compressing rollers is effected by means of a camming assembly including a generally clover-leaf-shaped cam and a cooperating cam follower.

In another embodiment of the invention the shifting of the tubing compressing rollers between operative and inoperative modes is achieved through actuation of mechanically controlled camming apparatus which is simply and conveniently manually manipulated.

It is an important feature of the present invention that there is provided a principal hydraulic reservoir in fluid flow communication with fluid-pressure-responsive elements acting on each of a plurality of piston-like elements coupled to each of an associated roller, whereby application of fluid pressure to fluid contained in the reservoir operates to effect displacement of the rollers radially outwardly and into compressing engagement with tubing present in an arcuate tube-receiving channel of the pump housing.

A related feature of the invention is that there is provided a digitally manipulable control knob for advancing a plunger into and withdrawing the plunger outwardly of the hydraulic reservoir to displace and to apply pressure to and to remove pressure from the tubing-engaging rollers of the pump.

In a specific embodiment the pump of the invention is adapted for use in medical procedures, including in procedures involving the employment of endoscopic instruments equipped with connections and lead lines for introducing fluids into and circulating fluids through and from body cavities.

In a preferred embodiment of the invention the peristaltic pump is used in carrying out urological procedures in which fluid is charged into and retrieved from the bladder, and for conducting related surgical techniques.

It is an important feature of the present invention that it ensures that the flexible and resilient tubing section may be loaded into and unloaded from the pump assembly in a safe, simple and convenient manner, and rapidly.

BRIEF DESCRIPTION OF THE DRAWINGS

Novel features of the invention are defined in the appended claims. The invention itself will be best understood and the above-identified and other objects, advantages and features of the invention will be understood upon referral to the following detailed description considered in conjunction with the drawings.

DETAILED DESCRIPTION OF PREFERRED EMBODIMENT

Figures 1, 2, 3:
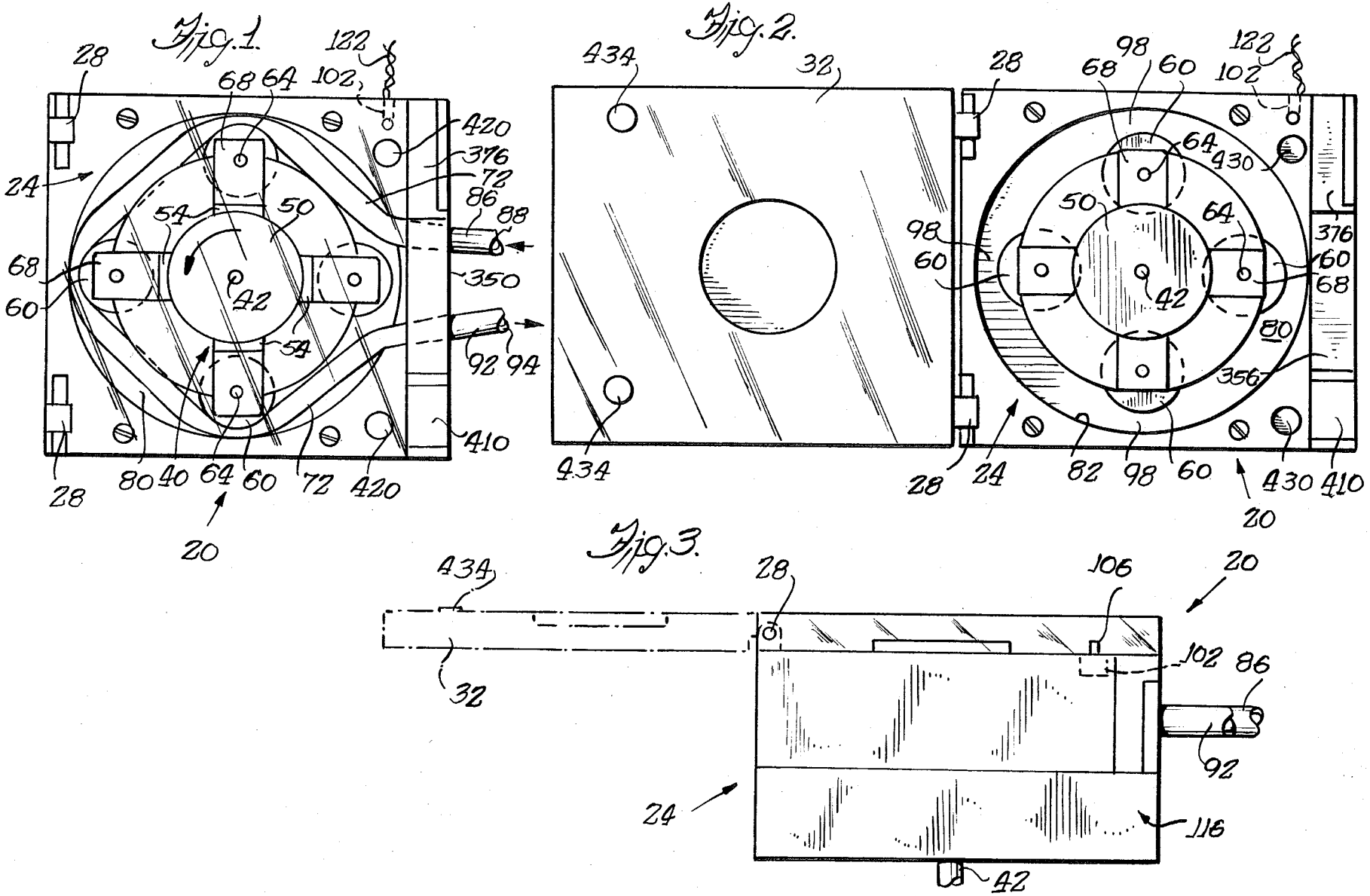
FIG. 1 is a top plan view of a peristaltic or tube pump, according to the invention, showing the tubing-engaging rollers extended, and the tubing in its compressed, operational mode.
FIG. 2 is a view similar to FIG. 1 but with the hinged transparent cover of the pump open, and with the tube-compressing rollers in a retracted mode and the tubing removed.
FIG. 3 is a side elevational view of the pump mechanism of FIG. 1, but with the cover open.
Figure 4:
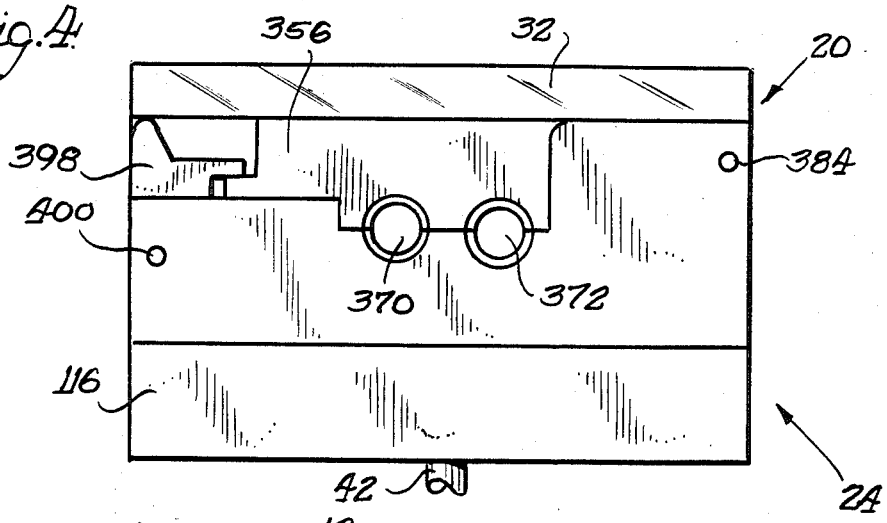
FIG. 4 is an end elevational view of the structure of FIG. 1, and showing the tubing retained between the body of the pump and the overlying hingedly pivotal tubing-locking arm.
Figure 5:
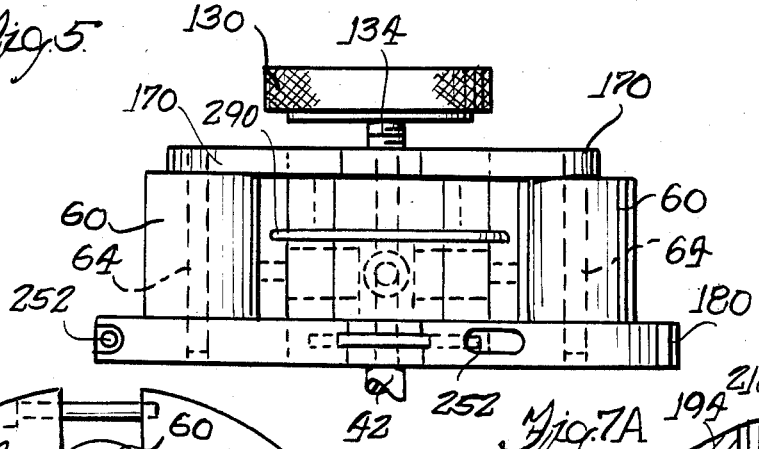
FIG. 5 is a side elevational view of one embodiment of the pump of the invention, with the housing removed and indicating schematically the principal and auxiliary hydraylic piston-and-cylinder assemblies for displacing the tubing-engaging rollers radially outwardly for engaging the tubing in an operational mode.
Figure 6:
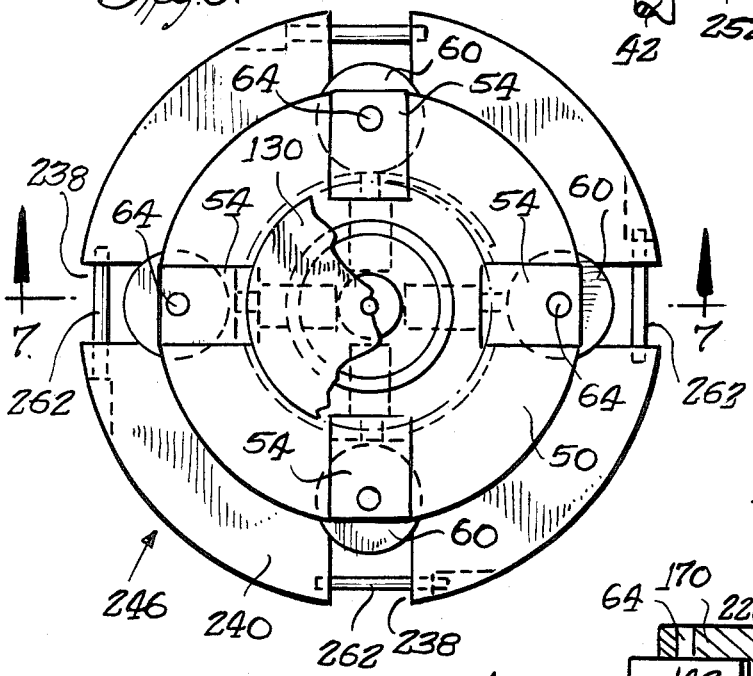
FIG. 6 is a top plan view of the structure depicted in FIG. 5 and showing, diagramatically, the hydraulic piston assemblies for displacing the tubing-engaging rollers radially outwardly, and a coil spring for biasing the rollers radially inwardly, and into a tubing-releasing mode.

The aims and objects of the invention are achieved by providing in a peristaltic pump including a motor-driven rotor connected to an array of circumferentially disposed, radially outwardly directed tubing-engaging rollers, structures for selectively displacing the rollers radially inwardly and out of stressing engagement with resiliently compressible tubing seated in a pump housing, thereby to facilitate safe, rapid and simple loading of the tubing into and removal of the tubing from the pump assembly.

In one embodiment of the invention, radial displacement of the rollers is effected through a roller-carrying yoke connected in turn to piston and cylinder assemblies. Biasing spring mechanisms serve to urge the rollers radially inwardly when hydraulic pressure is released from application to the piston. In another embodiment of the invention, manually controlled rotatable gearing is used to position the tubing-engaging, fluid-impelling rollers selectively between tubing-stressing and tubing-releasing modes.

In still another embodiment of the invention, the shifting of the tubing compressing rollers or arms between tube-stressing and tube-releasing modes is achieved by means of cam and cam follower mechanisms, manually operated.

Since peristaltic pumps or hose pumps are well known in the art, no exhaustive description of their operation is deemed necessary herein.

Each embodiment of the peristaltic pump of the invention includes simple yet highly effective and reliable structures for effectively enhancing the ease of inserting or positioning the tubing section in place within the embracing arcuate channel of the pump housing. The removal of the compressible tubing from the pump upon completion of the operational procedure is also facilitated. An additional safety feature is an interlock switch which prevents the pump from operating until the pump cover is properly oriented in a closed position.

Referring now to the drawings, and more particularly FIGS. 1 through 5, there is shown one preferred embodiment of the peristaltic pump of the invention provided for illustrative purposes and not to be construed in any limiting sense. The peristaltic pump 20 consists, in the embodiment illustrated, of several distinct mechanical components, including a body casing or housing 24, a hingedly secured 28 cover or closure 32, and a rotor assembly 40 the latter being provided with a shaft 42 and with a shaft-carried coupler 44 for attachment to a driving motor (not shown). In the example illustrated, the pump body is fabricated of an aluminum alloy and the cover is of a transparent plastic such as polyacrylate or a polycarbonate.

The peristaltic pump 20 is depicted 20 in its operational mode in FIG. 1. As shown, attached to the drive rotor, core or hub 50 are a series of annularly spaced, radially outwardly extending arms 54. A wheel, roller or pressing roll 60 is rotationally mounted by means of an axle-like shaft or pin 64 at an outwardly directed terminal or end 68. The rollers 60 are shown as bearing against to compress and constrict resiliently compressible tubing 72 confined in a cooperating arcuate channel 80 within the pump body. The channel 80 in the pump casing has a uniform radius of curvature and as the rotor 50 revolves, the rollers 60 advancingly compress the tubing 72 against an innner peripheral surface of the channel-bounding wall 82 so that fluid present in the tubing 72 is caused to flow steadily through the tubing as the rollers traverse their annular orbit within the bounds of the tubing-confining channel 80.

Upon a counter-clockwise direction of rotation of the rotor 50 and its associated presser rollers 60, an upper stub 86 of the tubing 72 defines a fluid inlet port 88 while the lower positioned stub 92 defines the fluid exhaust port 94.

FIG. 2 depicts the pump 20 with the top or closure 32 in an open position. The roller-carrying arms and their associated tube-compressing rollers 60 are shown in a radially inwardly retracted mode to establish substantial radial spacing 98 between the rollers 60 and the facing wall 82 of the encircling channel 80. It will be appreciated that, in accordance with the present invention, the configuration thus established permits the safe, simple and rapid removal of the resiliently compressible tubing sector from, as well as the insertion of the resilient tubing 72 into the channel 80 of the pump casing or housing 24, thus achieving an important goal of the subject development.

An additional safety feature of the present invention is the provision of a motor controlling interlock microswitch 102 actuated through a pin 106. The switch 102 is housed in a bore 110 extending downwardly into the housing or body 116 of the pump so that in an open position of the switch 102, the actuating pin 106 extends upwardly of the top surface 118 of the body 116 of the pump housing 24. The switch 102 is connected electrically by means of wires 122 to a motor (not shown) which drives the pump rotor 50. In the arrangement described, to initiate or to permit pump operation it is necessary that the cover 32 of the pump 20 be pivoted to a closed position, thereby physically to bear upon and to depress the pin 106 in order to complete a power circuit to the drive motor.

Figure 7A:
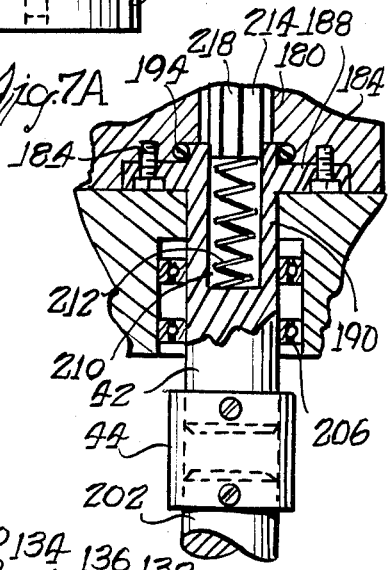
FIG. 7A is an enlarged, fragmentary view showing the manner in which the rotor-driven shaft is attached to the rotor assembly, in one embodiment of the invention.

It is within the inventive concept of the present invention to employ any one of several different structures including various mechanical and hydraulic arrangements for effecting the radial displacement or for selecting the position of the tubing compressor compressing rollers 60 to facilitate the loading of the compressible tubing 72 into and removal of the tubing 72 from the channel 80 of the pump housing 24. In the embodiment of the invention shown in FIGS. 5, 6, 7 and 7A, the shifting of the rollers is controlled hydraulically using principal and secondary piston and cylinder assemblies. Shown in FIGS. 7 and 7A, a knurled, hand-operated roller-positioning and control knob or disc 130 is connected to a downwardly projecting threaded shaft 134 extending through a matingly threaded collar or support plate 136 secured in the rotatable core 50 of the pump 20. The shaft 134 carries a piston 138 sleevedly and reciprocably operable in a master cylinder 142, a suitable O-ring 144 encircling piston 138 for fluid-sealing engagement with the bounding wall 146 of the cylinder. The master cylinder 142 is in fluid-flow communication with a spider-like array of quadrantly-spaced, laterally-extending secondary cylinders 148 through an annular duct-like passageway 150. Pistons 154 in the secondary cylinders 148 and fitted with O-rings 156 are threadedly fastened through outwardly extending stub-like rods 160 into cooperating threaded bores 162 formed in vertically extending walls or plates 164 of C-shaped, roller-carrying yokes 166. The yokes 166, which open radially outwardly, include upper and lower plates 170 and 172 between which the tubing-compressing rollers 60 are secured by their support shaft 64.

The core-like body of the rotor assembly 40 in which the cylinders 148 are housed, and the base 180 of the rotor, are bolted 184, at a collar-like flange 188 to a tubular section 190 of a shaft 42 which projects through and below the base 180 of the pump housing. The flange 188 of the shaft 42 is sealed to the roller base 180 by means of an O-ring 194. As indicated schematically in FIG. 7A, the rotor drive shaft 42 is attached by a sleeve coupler 44 to a shaft 202 of a motor (not shown) for driving the pump 20. The shaft 42 is stabilized against lateral displacement in the base of the rotor 50 by a pair of vertically-spaced bearings 206.

Figure 7:
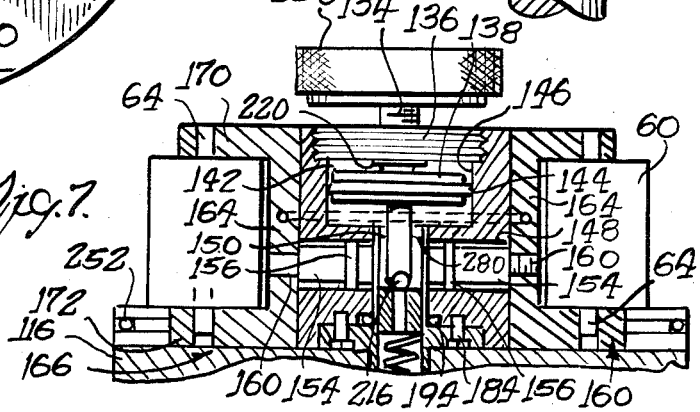
FIG. 7 is a cross-sectional view taken substantially on the lins 7—7 of FIG. 6 and showing the principal and the auxiliary pistons and cylinders of the roller displacing hydraulic assemblies, in accordance with one embodiment of the invention.

The rotor drive shaft 42 is formed with an upwardly-opening, axial bore 210 which houses a coil spring 212. The latter abuts the base of a rod-like lifter plug 214, interposed between the top of the spring 212 and a bearing 216 at the base of the shaft 134 (FIG. 7). The plug 214 is formed with a longitudinally extending flat or groove 218 functioning as a fluid flow passage or duct to facilitate entry of hydraulic fluid into the roller controlling cylinders 148 from the feed passage 150

The force exerted by the spring 212 enhances the upward displacement of the upwardly travelling piston 138 of the master cylinder 142. A washer 220 fixed on the shaft 134 beneath the support plate 136 limits the upward travel of the shaft 134 and the piston 138 carried thereby.

Figures 8, 9, 10, 11:
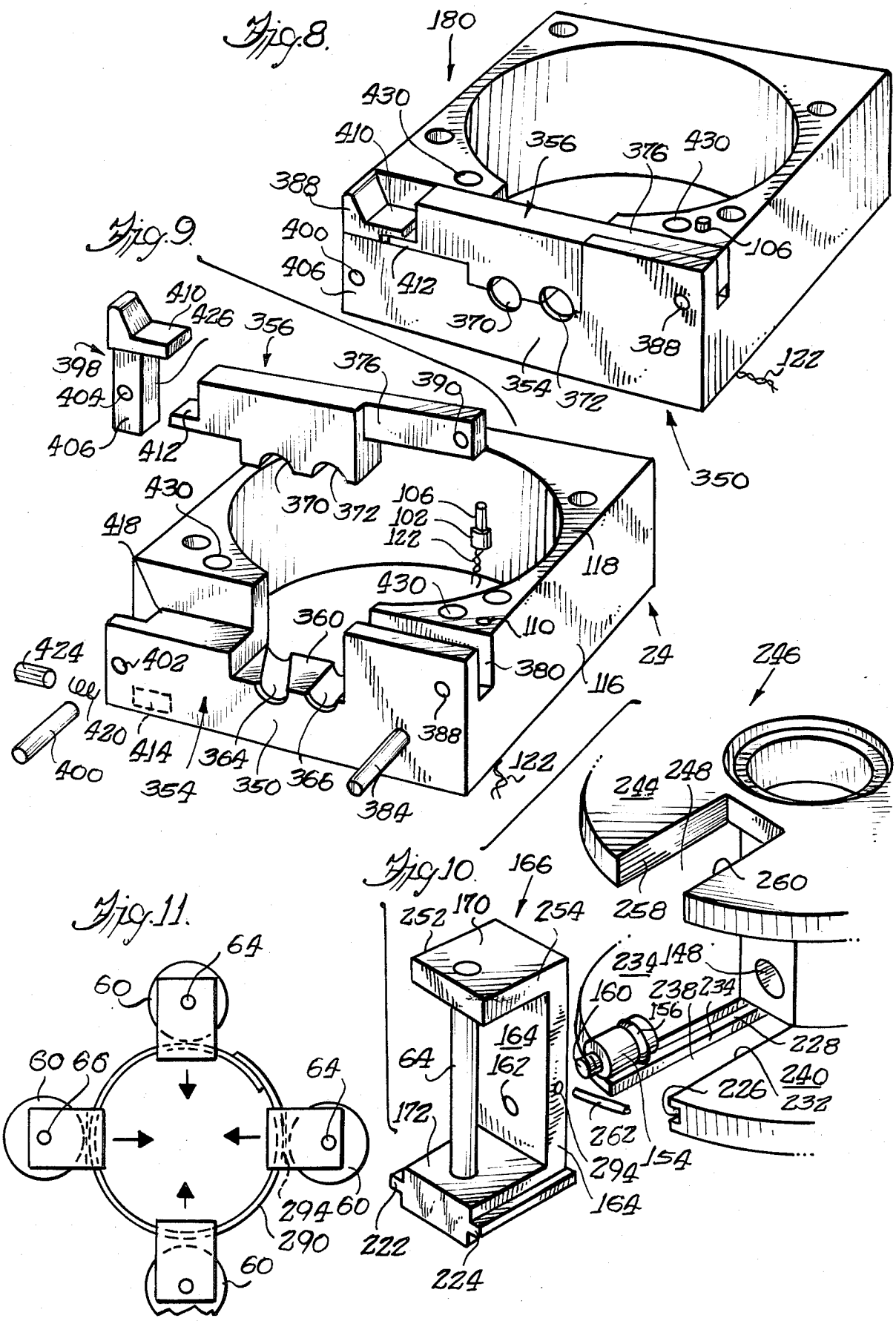
FIG. 8 is a perspective view of the body or housing of the pump of the invention with the core including the rotor mechanism and tubing removed.
FIG. 9 is an exploded view of the housing of FIG. 8 indicating schematically the mode of attachment and the operation of the tubing clamping arm assembly, and a cover engaging safety interlock to permit operation of the pump only when the cover of the pump housing is closed.
FIG. 10 is an enlarged, fragmentary, exploded view indicating schematically the structural arrangement of the components by which a roller-carrying yoke is displaced radially outwardly through action of a piston connected thereto.
FIG. 11 is a diagrammatic representation showing a top plan view of the arcuately arrayed rollers of the pump assembly and indicating the action of the yoke-engaging loop spring for biasing the yoke-carried rollers inwardly and away from the tubing.

As best seen in FIG. 10, the roller-carrying yoke 166 includes outwardly-directed lateral flanges 222 and 224 extending along each of opposed sides of the lower plate 172. These flanges 222 and 224 are slideably received in cooperating key ways or guide slots 226 and 228 formed in the side walls 232 and 234 bounding a cut-out section 238 of a floor 240 of the rotor assembly 40. An upper plate 244 of the spool-like body 246 of the rotor assembly 40 is formed with a cut-out section 248 extending radially inwardly and opening outwardly, the upper cut-out 248 being aligned vertically with the lower cut-out 238. The upper cut-out or slot 248 is sized slideably, telescopically to receive therewithin the top plate 170 of the yoke 166 as the latter is moved, reciprocally, inwardly and outwardly from the core or center hub 50 of the rotor assembly 40.

During such reciprocal movement, the opposed lateral side surfaces 262 and 254 of the upper plate 170 of the yoke 166 contiguously abut, in bearing relationship, the sides 258 and 260 demarking the lateral bounds of the upper slot 248. A horizontal rod 252 fastened to the floor 240 of the spool 246 and bridging the slot 238 adjacent a radially outward limit serves as a mechanical stop to limit outward displacement of the yokes 166 and the roller 60 carried thereby.

It will be understood from the foregoing description that as the control disc 130 is rotated in a direction to advance the piston 138 into the cylinder cavity 142, the hydraulic fluid 280 in the cylinder 142 is forced into the laterally extending channels 148 communicating therewith. The fluid 280 transfers pressure to bear against the laterally displaceable pistons 154 to urge the pistons 154, the yokes 166, and the rollers 60 carried thereby radially outwardly and into functional engagement with the compressible tubing 72 confined in the arcuate channel 80.

Turning the control disc 130 in the opposite annular direction removes pressure from the yoke-driving pistons 154 to permit the yoke-carried roller 60 to move radially inwardly and away from the arcuate channel 80 and the tubing 72 confined therein.

In the preferred embodiment of the invention illustrated in FIGS. 5 through 7, 7A , 10 and 11, and as shown most clearly in FIGS. 10 and 11, the withdrawal of the rollers 60 radially inwardly, upon relieving the hydraulic pressure applied thereto, is aided and enhanced by auxiliary apparatus. This apparatus includes a ring-like wire spring 290 (FIG. 11) which is trained through bore-like openings 294 extending laterally through the vertical plates 164 of the roller-carrying yoke 166. The spring 190 is biased to contract or shorten circumferentially (contract radially) so that it serves resiliently to urge the yokes 66 and the rollers 60 carried thereby radially inwardly and away from the tubing 72. While the force exerted by the spring 290 is readily overcome by the hydraulic forces transmitted against the yoke-shifting cylinders 148, when this hydraulic force is removed (through appropriate rotative manipulation of the control disc 130) the biasing force of the spring 290 is sufficient to cause the rollers 60 to move radially inwardly within the spool 246 as indicated schematically in FIG. 11. In the latter mode of the roller assembly, the tubing may be readily inserted into or removed from the pump 20.

Figure 12:
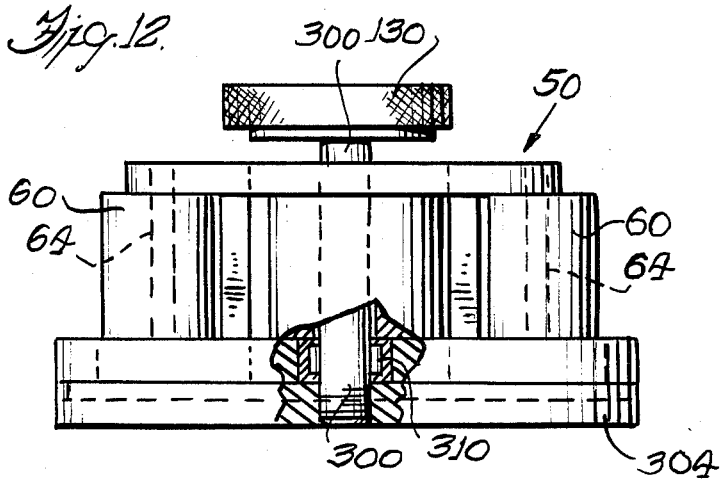
FIG. 12 is an elevational view, with parts cut away, and showing a second embodiment of the core of the pump of the invention in which the displacement of the rollers is effected through a gear assembly.
Figure 13:
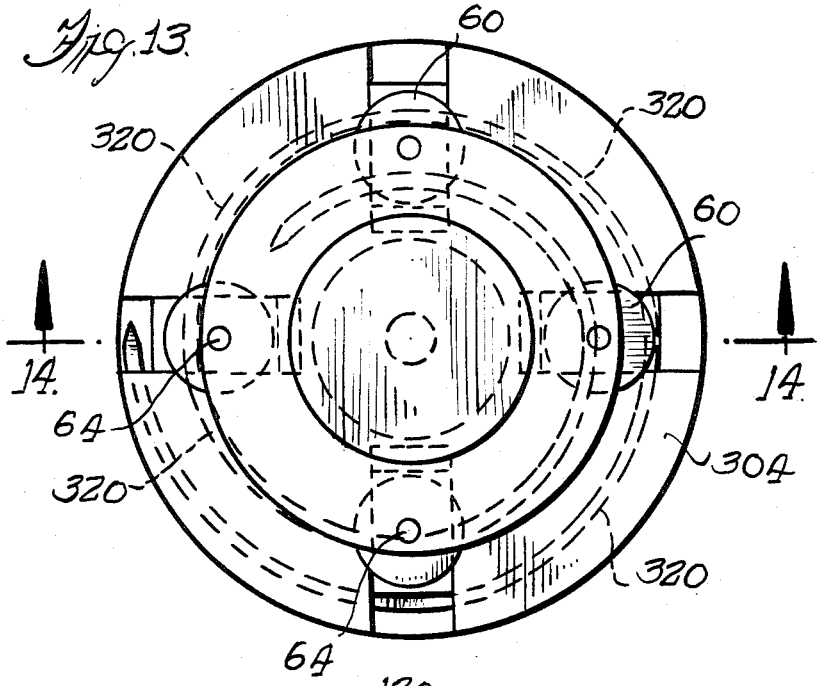
FIG. 13 is a top plan view of the structure depicted in FIG. 12 and showing schematically a base-carried helical gear for coupling with roller controlling rack gears for positioning of the roller assemblies of the pump.
Figure 14:
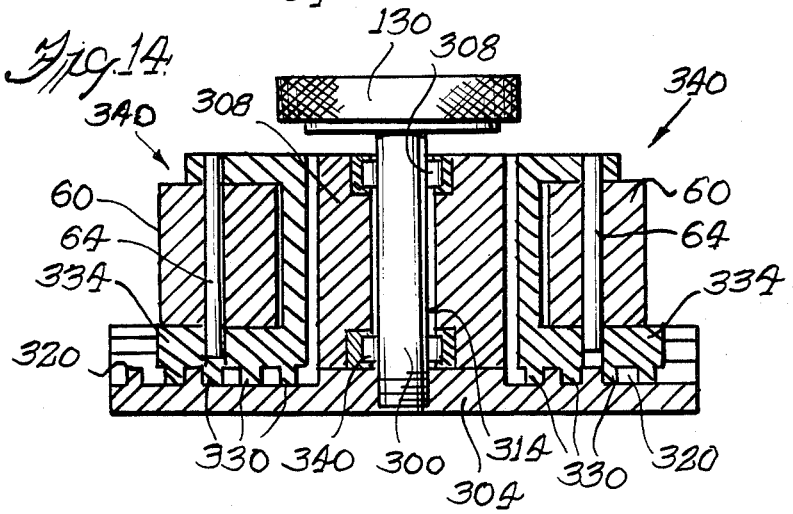
FIG. 14 is a cross-sectional view taken substantially on the lines 14—14 of FIG. 13 and showing the rack-like gears of the roller carrying yokes engaging the dial-controlled helical gear at the base of the assembly.

In a second embodiment of the invention, the retraction of the rollers 60 to facilitate the safe and convenient insertion and withdrawal of the compressible tubing 72 from its channel 80 is carried out using mechanical linkage. As shown in FIGS. 12 through 14, control disc 130 is connected by a shaft 300 to a base plate or floor 304 of the rotor assembly 40. The shaft 300 is mounted in a pair of bearing assemblies 308 and 310 carried by the bore 314. The top surface of the floor 304 of the rotor assembly 40 is formed as a convoluted or spiral gear 320 having a fixed curvature with even radial spacing between successive adjacent "turns". The turns intermesh with correspondingly radially-spaced rack-like bar sections 330 depending from the underface of each lower plate 334 of each yoke 340.

As the control disc 130 and the shaft 300 attached thereto are rotated in a given direction, the floor 304 of the assembly turns. At the same time, the floor-carried convoluted gear 320 turns and drives the intermeshing bar sections 330 and their associated roller-carrying yokes 340 either radially inwardly toward or radially outwardly of the shaft 300, the direction of displacement depending on the direction in which one rotates the control disc 130. In accordance with the method and apparatus described, the rollers 60 are positioned to permit safe and convenient insertion of and withdrawal of the compressible tubing 72 from the channel 80.

Other mechanical roller-shifting mechanisms including a manually-operable, appropriately-contured cam system, for example a four-leaf clover cam, and associated cam-followers may be used, in accordance with the concept and the teachings of the invention. Many camming assemblies suitable for use in practicing the invention are known in the art, and, accordingly, no detailed description is provided herein.

Still other mechanical features contributing to the utility and enhancing the operation of the pump 20 of the invention are illustrated in FIGS. 8 and 9. As shown, the front wall 350 of the pump housing 24 through which the tubing leads 92 (FIG. 1) and 86 project when the tubing 72 is in position in the pump is slotted and cut laterally lengthwise to divide the wall 350 into two separate but intercoupling wall components 354 and 356. The slotted, fixed component 354 remains an integral part of the housing itself. A generally centered horizontally-extending shelf portion 360 of the fixed section 354 of the wall 350 is formed with a pair of generally trough-shaped cut-outs 364 and 366 extending transversely of the wall 350 which serve as tray-like guides or seats for the tubing 72. The severed upper portion 356 of the wall 350 is formed on its underface with a pair of corresponding downwardly open trough-shaped cut-outs 370 and 372 for opposed registry with the cut-outs 364 and 366 in the base portion 354 of the wall 350. As indicated in FIGS. 1 and 8, the compressible tubing is effectively clamped in place in tubing ports 370 and 372 when the wall assembly is in its assembled configuration (FIG. 8).

The wall component 356 includes a narrowed, bar-like tongue 376 which is the mating male conterpart of an upwardly opening, open-ended slot 380 in the fixed wall 354 for pivotal movement therewithin. The tongue 376 is hingedly attached in the slot 380 by means of a hinge pin 384 passing through aligned bores 388 and 390 in the wall 350 and in the tongue 376. At its end opposite the slot 380 the wall 354 is formed with a second slot 390 opening laterally and upwardly for receiving a pivotally secured post-like hinge key 398 fastened in place by a hinge pin 400.

The pin 400 passes through a hole 402 in the wall 354 and through an axially cooperating hole 404 extending through a leg 406 of the hinge key 398. The hinge key 398 is surmonted by a laterally-extending flange 410 which overlies and bears upon a rearwardly extending shoulder plate 412 of the wall segment 356 when the latter is in place (FIG. 8).

A lower end of the wall section 354 adjacent the wall segment 406 is formed with a bore 414 extending inwardly of a lateral face 418 thereof near the bottom. A coil spring 420 and a pin 424 are retained in the bore 414, the spring 420 biasing the pin 424 outwardly and into stressing engagement with a face 426 of the hinge key 398 presented thereto when the key 398 is hingedly mounted in place on the hinge pin 400. The biasing force of the spring 420 is overcome and the locking post 398 swings outwardly to release the plate 212 upon pivotally lifting the wall element 356 pivotally to swing to an open position on the hinge pin 384. This maneuver allows ready access to the tubing ports 370 and 372.

The post hinge pin 400 in combination with the cooperating pin 424 and spring 420 impart toggle-like operationally features to the locking post 398. When the pivotal clamping wall 356 is closed to assume a tubing-clamping mode, it is necessary merely to shift the post 398 clockwise on its pin 400 to bring the plate 410 of the post 398 to overlie the shoulder plate 412 of the wall 356 to secure the latter in a closed configuration.

The cover 32 of the pump assembly may be of metal or metallic alloy, or may be a sheet of a plastic composition, such as polyacrylate or polycarbonate. If of metal, it is preferred that a transparent window section be included to permit one to observe the operation of pump 20 during use, and with the cover 32 in a closed position.

As indicated schematically in FIGS. 1 and 2, in a preferred embodiment of the invention the underside of the core 32 and the top surface of the body 180 or housing of the core carry magnet elements 430 and 434 for superimposed intercooperating registry, when the cover is in its closed position. The feature described prevents the inadvertent opening of the assembly.

What is claimed is:

1. A peristaltic type tubing pump for driving and for controlling the flow of fluid through fluid-conducting tubing positioned in a channel in said pump, said pump comprising:

housing means for supporting operational components of said pump, wall means in said housing including means defining an arcuate channel for receiving tubing therewithin and including a circumscribing bounding wall portion for contiguous abutment with a lineal section of compressible tubing confined in said channel during operation of said pump, rotor means and means for rotatably supporting said rotor means within said housing means for rotation about a fixed axis of said rotor means concentric with and displaced radially inwardly of said arcuate channel, means for coupling said rotor means to motor means for rotatably driving said rotor means, roller means for sequentially engaging and bearing upon resiliently-compressible tubing positioned in said pump, and means securing said roller means at a radially outwardly directed circumferential zone of said rotor means for bearing against the resiliently-compressible tubing confined in said arcuate channel during rotation of said rotor means, roller positioning means for selectively shifting said roller means between a first position in which said roller means are urged outwardly of a rotational fixed axis of said rotor means stressingly to bear upon and compress resiliently-responsive tubing confined in said arcuate channel of said pump to compel roller-means-propelled travel of fluid through said tubing during rotation of said rotor means, and a second position in which said roller means are retracted radially inwardly of and away from said wall means of said arcuate channel to facilitate loading entry of tubing into and unloading withdrawal of tubing from said arcuate channel of said pump, said roller positioning means comprising hydraulic control means including cylinder means and fluid-actuated piston means, means coupling said roller means to said piston means, and means for controllably selectively varying fluid volume in said cylinder means for controlling advance of and allowing retraction of said piston means and of said roller means coupled thereto for effecting selective radial positioning of said roller means within said housing means of said pump.

2. The structure as set forth in claim 1 wherein said means securing said rotor means include arm means and means fastening said arm means to said rotor means to project radially outwardly for sequential presentation of said roller means along said confining bounding wall portion of said arcuate channel during rotation of said rotor means.

3. In a peristaltic pump including housing means for supporting operational components of said pump, wall means in said housing means including means defining an arcuate channel for receiving tubing therewithin and including a circumscribing bounding wall portion for contiguous abutment with a lineal section of tubing confined in said channel during operation of said pump, rotor means and means for rotatably supporting said rotor means within said housing means for rotation about a fixed axis of said rotor means concentric with and displaced radially inwardly of said arcuate channel, roller means for sequentially engaging and bearing upon resilient tubing positioned in said pump, and means securing said roller means at a radially outwardly directed circumferential zone of said rotor means for bearing against resiliently compressible tubing confined in said arcuate channel during rotation of said rotor means, the improvement comprising:

hydraulically-controlled roller positioning means including cylinder means and fluid-actuated piston means for selectively shifting said roller means between a first position in which said roller means are urged radially outwardly of a rotational said fixed axis of said rotor means stressingly to bear upon and to compress resiliently responsive tubing confined in said arcuate channel of said pump to compel roller-means-propelled travel of fluid through tubing during rotation of said rotor means, and a second position in which said roller means are retracted radially inwardly of a bounding face of said wall means of said arcuate channel to facilitate loading entry of tubing into and unloading withdrawal of tubing from said arcuate channel of said pump.

4. The structure as set forthin claim 1 wherein said hydraulic control means includes fluid reservoir means for retaining a supply of hydraulic fluid, fluid passage means interconnecting said fluid reservoir means with fluid contained in said cylinder means for establishing fluid communication therebetween, plunger means for displacing fluid contained in said reservoir means, and means for controllably positioning said plunger means selectively to apply pressure to and to relieve pressure applied to fluid contained in said fluid reservoir means and in said cylinder means communicating therewith.

5. The structure as set forth in claim 4 wherein said means for controllably positioning said plunger means includes a manually manipuable control disc, shaft means connected to said control disc and to said plunger means, and means responsive to rotation of said control disc for selectively displacing said plunger means to move inwardly of and outwardly from said fluid reservoir means.

6. The structure as set forth in claim 1 and further comprising arm means fastened to and projecting radially outwardly of said rotor means, and means securing said roller means to said arm means at end zones thereof.

7. The structure as set forth in claim 6 wherein said means securing said arm means to said roller means include generally C-shaped yokes carried by said arm means, and rod means fastened in said yokes and passing axially through said roller means positioned in said yokes and secured therewithin.

8. The apparatus as set forth in claim 1 and further comprising plunger means for controllably varying fluid volume in said cylinder means, and means for controllably advancing said plunger means into and retracting said plunger means from said cylinder means, spring means for biasing said roller means radially inwardly toward said rotor means and away from said wall means of said arcuate channel, said spring means being effective to displace said roller means from stressing engagement against tubing seated in said channel, upon retraction of said plunger means from said cylinder means.

9. The structrue as set forth in claim 1 and further comprising cover means overlying said housing means, and hinge means fastening said cover means to said housing means for opening and closing a face thereof for providing access into said housing means and to said channel for placement of the tubing therewithin, normally-open electrical interlock switch means for protectively controlling energizaton of the rotor driving motor means, and means supportng said switch means in said housing, switch-actuating means oriented for engagement with said cover means upon closure thereof and responsive to displacement pressure of said cover means to close said electrical interlock switch means for energizing the motor means to drive said rotor means, said switch means serving to prevent operation of said pump until said cover means is in a closed position.

10. The structure as set forth in claim 8 wherein said spring means is a spiral spring.

11. In the operation of a peristaltic pump of the type including a housing and wall means in said housing, said wall means defining an arcuate channel for receiving tubing therewithin and including a circumscribing bounding wall portion for contiguous abutment with a lineal section of tubing confined in said channel during operation of said pump, rotor means and means for rotatably supporting said rotor means within said housing means for rotation about a fixed axis of said rotor means concentric with and displaced radially inwardly of said arcuate channel, roller means for sequentially engaging and bearing upon resilient tubing positioned in said pump, and means securing said roller means at a radially, outwardly directed circumferential zone of said rotor means for bearing against resiliently compressible tubing confined in said arcuate channels during rotation of said rotor means, and including the steps of loading the resiliently compressible tubing into and removing the tubing from the arcuate channel, the improvment comprising the steps of providing pump-housed hydraulic means including cylinder means and fluid-actuated piston means, and actuating the hydraulic means for retracting the roller means radially inwardly and away from the tubing-receiving arcuate channel to increase spacing between the roller means and the arcuate channel thereby to facilitate the loading entry of the tubing into and the unloading withdrawal of tubing from the arcuate channel.

* * * * *